United States Patent [19]

Michaux

[11] Patent Number: 4,589,269

[45] Date of Patent: May 20, 1986

[54] DEVICE FOR MOVING AND AXIALLY ADJUSTING HORIZONTAL ROLLS OF A SECTION ROLLING MILL STAND

[76] Inventor: Jacques Michaux, 91, rue de Franchepré, 54240 Joeuf, France

[21] Appl. No.: 617,625

[22] Filed: Jun. 6, 1984

[30] Foreign Application Priority Data

Jun. 10, 1983 [FR] France ..... 83 09679

[51] Int. Cl.[4] ..... B21B 31/18

[52] U.S. Cl. ..... 72/247; 72/21; 72/237

[58] Field of Search ..... 72/21, 247, 237; 74/441, 333, 424.8 R, 89.15, 841; 192/108; 464/160, 162

[56] References Cited

U.S. PATENT DOCUMENTS

| | | | |
|---|---|---|---|
| 1,032,168 | 7/1912 | Waterhouse | 74/333 |
| 1,391,633 | 9/1921 | Hazelton | 74/424.8 R |
| 2,920,502 | 1/1960 | Bungart | 464/160 |
| 3,973,425 | 8/1976 | Woodrow | 72/247 |
| 4,248,074 | 2/1981 | Fuhrmann et al. | 72/247 |
| 4,389,865 | 6/1983 | Davies | 72/249 |

FOREIGN PATENT DOCUMENTS

| | | | |
|---|---|---|---|
| 1259818 | 2/1968 | Fed. Rep. of Germany . | |
| 2156438 | 6/1973 | France . | |
| 41-025073 | 12/1966 | Japan . | |
| 0073409 | 6/1980 | Japan | 72/247 |
| 878343 | 9/1961 | United Kingdom . | |
| 889062 | 2/1962 | United Kingdom . | |
| 1269875 | 4/1972 | United Kingdom . | |
| 1464654 | 2/1977 | United Kingdom . | |
| 1525124 | 9/1978 | United Kingdom . | |

*Primary Examiner*—Lowell A. Larson
*Assistant Examiner*—Robert Showalter

[57] ABSTRACT

The invention relates to an improved device for moving and axially adjusting horizontal rolls of a section for rolling mill stand, comprising an axial thrust bearing mounted in the envelope of a casing blocked on an element of the stand, a sleeve mounted for axial slide and fast with the outer race of the bearing, the sleeve being blocked in rotation in the envelope of the casing; a screw mechanism for adjusting the position of the sleeve with respect to the envelope of the casing comprising a thread on an outer part of the sleeve on which are screwed two pinion-nuts, two end stops formed on the casing, two shafted pinions pivoting in the casing each contiguous with a stop and meshing with a respective pinion-nut, the two pinion-nuts being provided on their opposite face with a dog-clutch. The shafted pinions may be controlled by motors having reversible rotation, and associated with pulse counters.

6 Claims, 3 Drawing Figures

DEVICE FOR MOVING AND AXIALLY ADJUSTING HORIZONTAL ROLLS OF A SECTION ROLLING MILL STAND

TECHNICAL FIELD

The present invention relates to an improved device for moving and adjusting in the axial direction the horizontal rolls of a section rolling mill stand.

BACKGROUND OF THE INVENTION

During rolling, the horizontal rolls of a section rolling mill stand may shift laterally from their correct position under the effect of the load. It therefore becomes necessary to be able to correct the lateral position of the horizontal rolls.

According to the state of the art, the rolling efforts in the radial direction are taken up on each side of each horizontal roll by radial bearings mounted on the neck of the roll and housed in chocks. The efforts in the axial direction are taken up on one side of each roll by an axial thrust-bearing mounted by its inner ring on a reduced neck in the vicinity of the first neck in a thrust casing fixed on the chock or on the columns of the stand.

The inner race of the axial thrust-bearing is blocked on the roll on one side by a shoulder and on the other side near the end of the neck by a spacer ring. The spacer ring is blocked by a screw-nut assembly retained by a circular groove made in the neck at its end.

The outer race of the axial thrust-bearing is fixed in a sleeve comprising a thread on its outer envelope screwing into the inner bore of the thrust casing.

A first shafted pinion, which is moved manually or by a motor, meshes with a pinion keyed on the sleeve so that the latter screws into the thrust casing and moves the roll with respect to pinion keyed on the sleeve.

A second shaft pinion (moved like the first), meshes with a second pinion which is internally threaded and screws on the sleeve thereby enabling the system to be blocked in the position desired for the roll by making up the clearances.

According to the known method for axially adjusting the horizontal rolls, it is necessary for each adjustment to perform three successive acts on the two shafted control pinions:

First unlocking the system with the blocking pinion-nut, second displacing the roll by the desired amount with the adjusting pinion and third, locking the system with the locking pinion-nut.

A drawback presented by the adjustment method known in the art is that the sleeve may be accidentally rotated by the axial thrust bearing when the latter develops greater than that of locking, by virtue of overload, friction, etc. Furthermore, control of the displacement is not guaranteed because of difficulty in measuring.

It is an object of the present invention to propose an improved device for the accurate, stable and controlled movement and axial adjustment of the position of a roll by actuating each time one shafted pinion only.

To this end, according to the invention, the improved device is mounted in a casing fixed on an element of the stand and which comprises an envelope in which a sleeve fast with the outer race of the thrust-bearing is mounted for axial slide, a mechanism being provided to adjust the position of the sleeve with respect to the envelope of the casing which offers easy handling and a good resistance to thrust. [The adjusting mechanism incorporates screws.]

The sleeve is blocked in rotation in the envelope of the casing, and the adjusting mechanism comprises: a thread on the outer part of the sleeve on which are screwed two pinion-nuts; two end stops formed on the casing; two shafted pinions rotating in the casing each contiguous to a stop and meshing with a respective pinion-nut.

The two pinion-nuts are provided on their opposite face with a dog-clutch operated by rotation of one or the other for an approach of the pinion-nuts less than the difference between the distance between the stops and the sum of the widths of the pinions. It is thus possible to act on one shafted pinion in order to unlock the position of the roll, to adjust it and lock it again as will be seen hereinbelow. Moreover, the sleeve can no longer be rotated accidentally since it is sliding and locked in rotation by a key.

The shafted pinions are advantageously controlled by motors with reversible rotation.

These motors may advantageously be used as pulse counters and the adjustment underway may be controlled precisely.

The invention finds particularly advantageous application in a bearing surface arrangement in which said bearing is an axial thrust-bearing. A second bearing is provided, mounted in the chock housed in the columns and exclusively taking up the radial loads supported by the roll.

The casing may be fixed on the chock.

Further features and advantages of the present invention will be more fully apparent from the following description and annexed drawings of the presently preferred embodiments thereof.

BEST MODE FOR CARRYING OUT THE INVENTION

Figure 1:
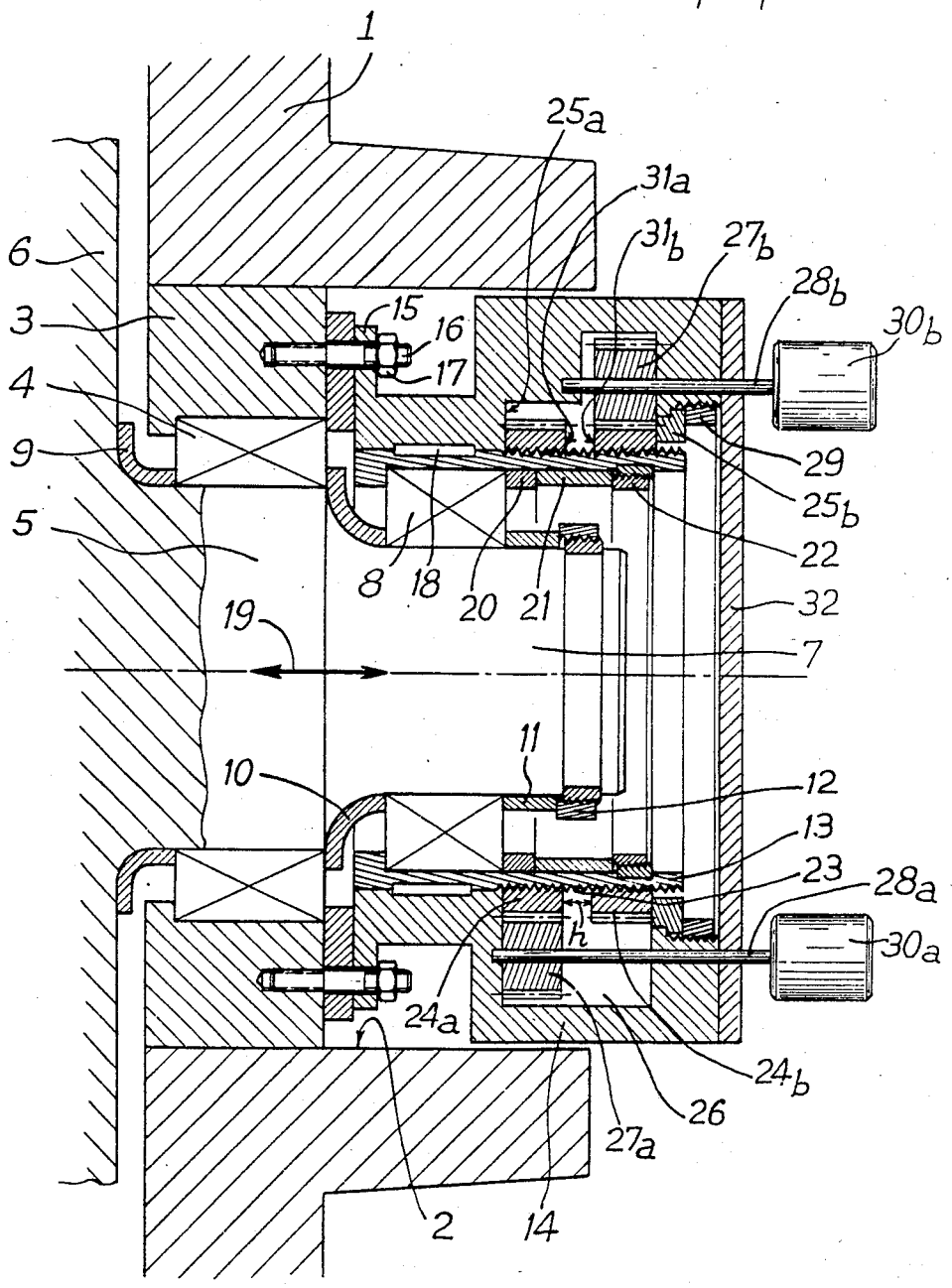
FIG. 1 shows a horizontal section through the end of a roll and the adjusting device of the invention.

Referring now to the drawings, FIG. 1 shows the columns 1 between which a chock 3 is housed. The columns 1 may form an integral whole forming a vertical window 2 for housing the chock 3. latter is fixed in known manner (not shown) on the columns 1.

The chock 3 is fixed (not shown) onto the columns 1 in any suitable manner known in the art. race of which is fixed on the body 5 of the neck of the roll 6.

The end 7 of the same neck, having a reduced diameter with respect to the body 5 of the neck, bears the inner race of an axial thrust-bearing 8.

Different shoulder (9,10) and bracing (11) rings serve for assembly of the inner races of the bearings 4 and 8, the whole being locked by a screw-nut assembly 12 placed at the end of the neck.

The outer race of the axial thrust-bearing 8 is fixed by means of bracing rings 20, 21 and a screw-nut assembly 22, in a sleeve slidably mounted to in the envelope of a casing 14. The casing 14 comprises lugs 15 enabling it to be fixed to the chock 3 by pins 16 and nuts 17.

Rotation of the sleeve 13 in the envelope of the casing 14 is prevented by a key 18.

The sliding of the sleeve 13 is controlled by an adjusting device enabling a controlled axial displacement of the rolls in the directions represented by the axial arrows 19.

The adjusting device comprises a thread 23 on the outer part of sleeve 13. Two pinion-nuts 24*a* and 24*b* are screwed onto this thread 23. The axial displacement of the two pinion nuts is limited by two stops 25*a* and 25*b* which constitute in part of the frontal faces of a housing 26 reserved in the envelope of the casing 14 facing a part of the thread 23. The space between the stops 25*a* and 25*b* is greater than the sum of the thicknesses of the pinion-nuts 24*a* and 25*b* by a length h. The length h is greater than the displacement permitted by the dog-clutch by the rotation of either of the pinions.

The housing 26 houses, in addition to the pinion-nuts 24*a*, 24*b*, pinions 27*a*, 27*b* keyed on shafts 28*a*, 28*b* which rotate in the envelope of the casing 14. The pinions 27*a*, 27*b* are contiguous with the stops 25*a*, 25*b*. To allow assembly, the stop 25*b* is made in the form of a removable ring locked by a screw-nut assembly 29.

The shafts 28*a*, 28*b* are controlled in rotation manually (for example by a ratchet handle) or automatically by two motors 30*a*, 30*b* with reversible rotation. These motors are connected to a control unit (not shown).

Figure 3:
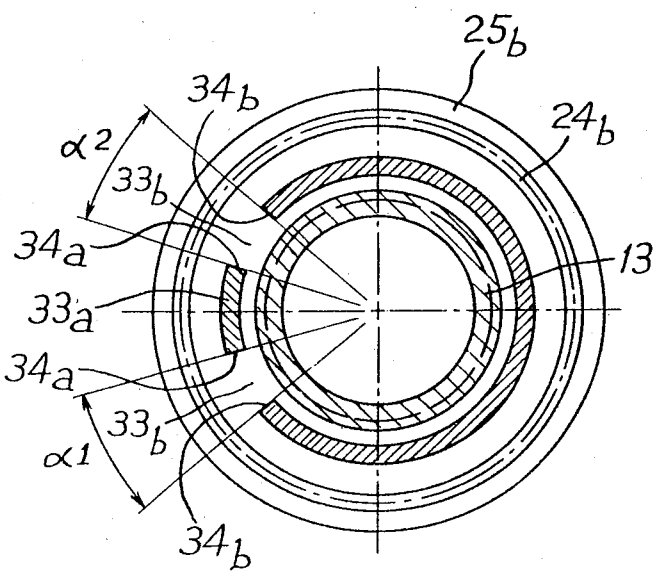
FIG. 3 shows the angles of clearance $\alpha 1$ and $\alpha 2$ in free rotation of the adjusting pinions.
Figure 2:
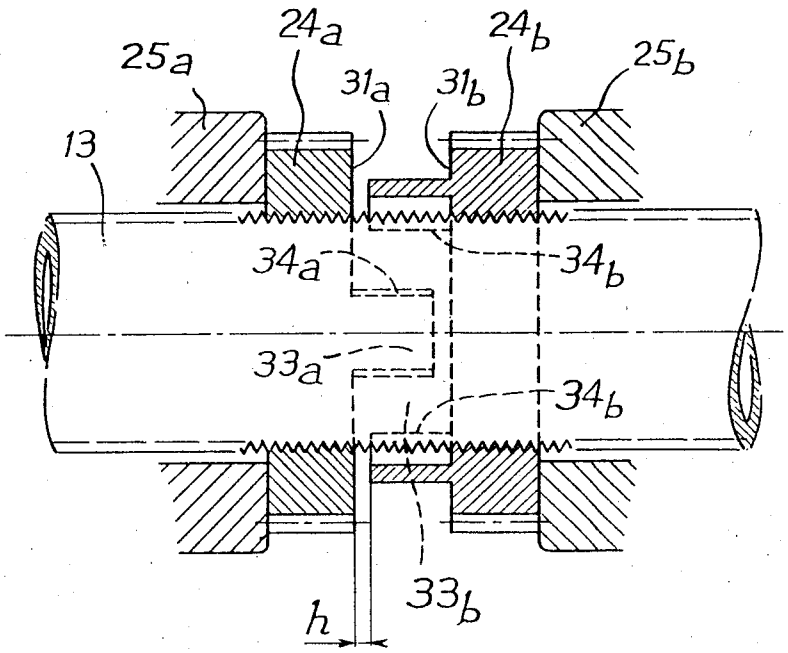
FIG. 2 shows the action of the dog-clutch in the movement of adjustment.

In their locking position, the pinion-nuts 24*a*, 24*b* are tightened on their respective stop 25*a*, 25*b* and prohibit any displacement of the sleeve 13 with respect to the envelope of the casing 14. The pinions 27*a*, 27*b* mesh with the pinion-nuts 24*a*, 24*b* whatever the position of the latter. The length h is to this end less than the thickness of a pinion-nut 24*a*, 24*b*. The pinion-nuts 24*a*, 24*b* (FIG. 2) comprise on their opposite faces 31*a*, 31*b* a dog-clutch. Meshing occurs after a free rotation of the controlled pinion having (FIG. 2) a male part 33*a* moving in the female part 33*b* of the dog-clutch of the driven pinion. The possible clearance in rotation of the controlled pinion 24*a* (FIG. 3) also moving axially as a function of the pitch of the connecting thread makes it possible to obtain in one direction of rotation the locking of the controlled pinion 24*a* on its own stop 25*a* without the male and female parts coming into contact (angle $\alpha 1$).

In the opposite direction, that of adjustment, the axial displacement which is always less than h first allows unlocking of the pinion 24*a*, then by rotation in the angle $\alpha 2$ the contacting of the male and female parts 34*a* and 34*b* therefore the drive of the pinion 24*b* which, bearing on its own stop 25*b*, causes the axial displacement of the threaded part 23 fast with the rotating stop 8, itself fast with the roll to be displaced.

In the case of reversal of the direction of adjustment of the axial displacement, the pinion which was driven becomes the controlled pinion and the controlled pinion becomes driven.

It is for this reason that the clearance in free rotation of the male part of the dog-clutch must be symmetrical in its possibilities within the female part. The angles $\alpha 1$ and $\alpha 2$ must be substantially equal.

The actions and interactions are simply reversed when the direction of adjustment changes.

A cover 32 may close the front end of the casing.

Operation of the bearing device according to the invention is as follows:

During rolling, appropriate lateral adjustment of the horizontal rolls in the vertical rolling plane may be achieved by acting particularly on the control members, motorized or not, of the shafts 28*a*, 28*b*.

On the upper roll, for example, there is mounted on axial thrust-bearing casing designed according to the invention with manual or motorized controls, which makes it possible during assembly to secure the correct position of the roll in the axis of the stand. This position, fixed and locked by the axial thrust-bearing, will serve as base for off-load adjustment.

On the lower roll there is mounted a thrust-bearing casing of identical design, preferably with motorized controls. At assembly, the lower roll is adjusted, like the upper roll, in the axis of the stand to respect the correct geometry of the rolling. The adjustments are effected off-load.

During rolling, under the load due to the working of the rolls or because of wear, said rolls may be offset from the correct geometry. Correction then be effected according to the invention, without difficulty and remotely by acting on the motorized control motors.

The reference taken into consideration will be the reference ascertained: sampling, for example, or reference taken by sensors monitoring the real position of the rolls during working, or indications of rolling effort sensors giving respectively the effort of each roll which is compared depending on the case, according to the relation that their ratio maintains with a constant value.

The correction system is designed in a manner such that each motor (30*a*, 30*b*) is specific for one direction of correction only.

A motor (30*a*, 30*b*) ensures both the unlocking of a first pinion-nut (24*a* or 24*b*) which, after engagement of the dog-clutch, will bring about the desired movement of a second pinion-nut (24*b* or 24*a*) which effects displacement of the sleeve 13. The movement is stopped at the appropriate value (which will have been displayed in the control unit) by the control of rotation (off-load) by means of a pulse counter fixed on the other motor 30*b* or 30*a* driven by the real movement of the second pinion-nut.

When the pulse counter has counted the number of pulses corresponding to the displayed value of the displacement, it stops the control motor 30*a* and 30*b* and reverses the direction of rotation thereof, which lacks the system by tightening of the first pinion-nut. The effort of locking and of unlocking is monitored by the torque of the hydraulic motor.

To effect a displacement in the opposite direction, the other motor 30*b* or 30*a* is chosen which then acts like the first motor had acted for the reverse movement, said first motor now having only to perform the role of pulse counter.

The pinion-nuts 24*a*, 24*b* act one on the other by a dog-clutch with limited free rotation sufficient to unlock the system (angle of 120° for example).

The operator has two control units at his disposal for each direction of displacement:

(1) a Vernier to display the amplitude of the desired displacement, (2) a button for starting up the control motor specific to the direction of displacement chosen.

The operator presses the appropriate start button and the whole sequence of the adjusting operation runs automatically.

The correction operation may also be monitored and controlled by an automatic piloted system either by comparison of the real position of the rolls (position sensors) or by comparison of the rolling efforts (effort sensors).

What is claimed is:

1. An apparatus for axially adjusting a horizontal roll of a section rolling mill stand of the type including an axial thrust bearing mounted within an envelope defined by a casing attached to the stand and fast with the roll, said apparatus comprising:

a sleeve fast with the axial thrust bearing for transmitting axial displacement of the sleeve to the roll via said bearing, said sleeve having an externally threaded section;

mounting means for mounting said sleeve within said envelope for allowing reciprocating axial sliding movement of said sleeve and for blocking rotation thereof;

first and second pinion nuts threadedly mounted in confronting rotation on the externally threaded section of said sleeve;

first and second pinion nut stop means formed on said casing adjacent said first and second pinion nuts, respectively, for limiting axial movement of said pinion nuts;

first and second pinion nut drive means for controllably rotating, respectively, said first and second pinion nuts, only one of said pinion nuts being controllably rotated at any one time; and clutch means formed on said pinion nuts for transmitting rotation from said one controllably rotated pinion nut to the other driven pinion nut and for allowing rotation of said controllably rotated pinion nut through a predetermined angle before said clutch means engages for drivably rotating said other pinion nut;

whereby when said clutch means is engaged and said one pinion nut is drivably rotating said other nut, said sleeve is displaced axially for adjusting the axial position of said roll, and when the rotation of said one controllably rotated pinion nut is reversed, said clutch means disengages and said one pinion nut is rotated in the reverse direction into a locking position against its respective stop means securing said sleeve against unintended axial movement.

2. The apparatus according to claim 1, wherein each of said pinion nuts has external gear teeth around its circumference, and wherein each of said pinion nut drive means comprises a shafted pinion gear intermeshing with the gear teeth of its respective pinion nut.

3. The apparatus according to claim 2, wherein each of said drive means further comprises a reversible motor attached to said shafted pinion gear.

4. The apparatus according to claim 3, further comprising pulse counting means attached to said shafted pinion gears for measuring the rotations made by said pinion nuts, whereby the displacement of the sleeve, and therefore the displacement of the roll, may be determined.

5. The apparatus according to claim 1, wherein the clutch means comprises dog clutch means having a female portion mounted on one of said pinion nuts and a male portion mounted on the other pinion nut, said male portion fitting inside the female portion with sufficient clearance to permit free rotation through said predetermined angle.

6. The apparatus according to claim 5, wherein said predetermined angle is 120°.

* * * * *